US005272890A

United States Patent [19]

Penxa

[11] Patent Number: 5,272,890

[45] Date of Patent: Dec. 28, 1993

[54] PORTABLE BEVERAGE COOLING APPARATUS

[76] Inventor: Jerome M. Penxa, 20383 Lida La., Clinton Township, Mount Clemens County, Mich. 48038

[21] Appl. No.: 954,559

[22] Filed: Sep. 29, 1992

[51] Int. Cl.[5] ..... F25D 3/08; 62 457.4;457.3;372;371; 220 23.83;737

[52] U.S. Cl. ..... 62/457.4; 62/372; 220/23.83

[56] References Cited

U.S. PATENT DOCUMENTS

| | | | |
|---|---|---|---|
| 3,161,031 | 12/1964 | Flannery . | |
| 3,302,427 | 2/1967 | Stoner et al. . | |
| 3,302,428 | 2/1967 | Stoner et al. . | |
| 3,703,816 | 11/1972 | Weathers . | |
| 4,163,374 | 8/1979 | Moore et al. . | |
| 4,183,226 | 1/1980 | Moore . | |
| 4,281,520 | 8/1981 | Norwood . | |
| 4,299,100 | 11/1981 | Crisman et al. . | |
| 4,324,111 | 4/1982 | Edwards . | |
| 4,338,795 | 7/1982 | House, Jr. . | |
| 4,344,303 | 8/1982 | Kelly, Jr. . | |
| 4,357,809 | 11/1982 | Hold et al. . | |
| 4,516,409 | 5/1985 | Hobbs | 62/457.5 |
| 4,577,474 | 3/1986 | Peterson . | |
| 4,580,412 | 4/1986 | Wells . | |
| 4,741,176 | 5/1988 | Johnson et al. . | |
| 4,745,776 | 5/1988 | Clark . | |
| 4,782,670 | 11/1988 | Lang et al. . | |
| 4,798,063 | 1/1989 | Rimmer . | |
| 4,882,914 | 11/1989 | Holmes-Keeley et al. . | |
| 4,932,225 | 6/1990 | Bighouse . | |
| 4,955,516 | 9/1990 | Sutterfield . | |
| 4,961,324 | 10/1990 | Allen . | |
| 4,989,415 | 2/1991 | Lombness . | |
| 5,001,907 | 3/1991 | LaCroix et al. . | |
| 5,024,067 | 6/1991 | Maier, II . | |
| 5,067,328 | 11/1991 | Medina et al. . | |
| 5,067,329 | 11/1991 | Tomlinson . | |

OTHER PUBLICATIONS

"Golfsmith ® Precision Golf Equipment" Jun. 1992, p. 23.

2 photographs of soft sided Camel insulated cooler.

4 photographs of cardboard "Stac-a-pak" cooler.

*Primary Examiner*—John M. Sollecito

*Attorney, Agent, or Firm*—Harness, Dickey & Pierce

[57] ABSTRACT

A compact beverage cooling apparatus having a plurality of tubular members coupled to one another thereby forming an elongated tubular member. These tubular members surround a plurality of beverage containers placed therein and cool the beverages since at least a portion of the members contain a of cooling material. In addition, a receiving member can be utilized to insert the beverage containers into, and withdraw the beverage containers from, the tubular members. When the beverage containers are inserted into the tubular members, they are placed in close proximity to the cooling material such that the beverage containers may be kept cool for long periods of time.

17 Claims, 4 Drawing Sheets

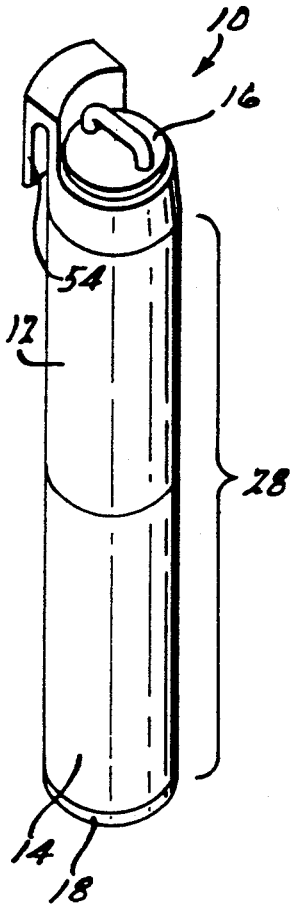
FIG. 1.
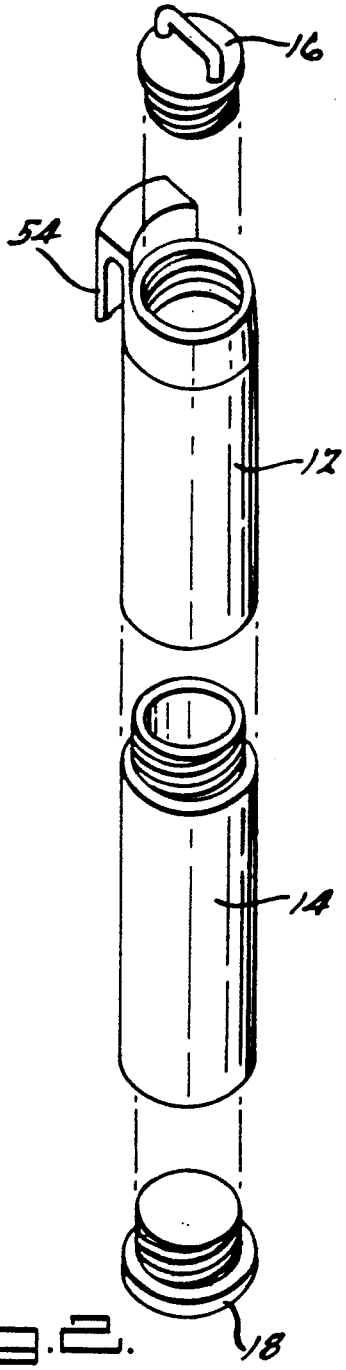
FIG. 2.
FIG. 3.
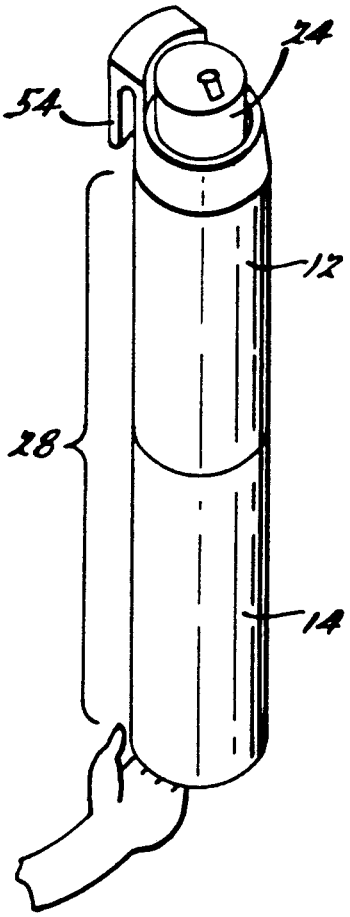

PORTABLE BEVERAGE COOLING APPARATUS

BACKGROUND AND SUMMARY OF THE INVENTION

This invention generally relates to a beverage cooling apparatus, and more particularly to a portable cooling apparatus having a cooling material that surrounds a plurality of beverage containers.

While participating in various summertime activities such as golf, baseball, etc., it is often desirable to consume cooled prepackaged beverages such as cans of soda. Accordingly, it is desirable to have a compact beverage cooling apparatus that can be easily transported by the person participating in the summer activity. For example, while golfing it would be most desirable to have a portable cooling apparatus that fits easily into a golf bag, thereby eliminating the need to carry both the golf bag and a separate beverage cooler. Generally, golfers have two options when attempting to transport cooled beverages, such as a six pack of soda cans. The first option is to carry a separate cooler that utilizes a freezable material to cool the beverages while being transported. Unfortunately, this type of cooling device is typically cumbersome and too large to fit into a golf club bag and therefore must be carried separately from the golf bag. The second alternative is to use a sleeve-like insulating device. These commonly utilized cooler devices include both soft fabric devices and rigid elongated devices. The soft devices are made of a relatively flimsy fabric material and do not provide the necessary insulating capacity to keep beverages cool for elongated periods of time—for example, 18 holes of golf. A typical rigid elongated container is made of a double layer of insulating cardboard material and is therefore relatively thick. This device is too bulky to fit into a golf bag and it does not provide the insulative capacity to keep beverages cool for 18 holes of golf or the like. Accordingly, it would be most desirable to have a beverage cooling apparatus that is compact enough to fit in a golf club bag while still being able to provide actual cooling to beverages in various containers.

Unlike the above described devices, the beverage cooling apparatus of the present invention utilizes hollow tubular members that contain a cooling material such as a conventional refrigerant gel. Moreover, this cooling apparatus is designed to readily fit within a conventional golf bag and to be broken down such that it fits within a conventional freezer. In operation, a user may place either warm or cooled beverages within the hollow tubular members for later consumption. The cooling apparatus is then placed directly into a golf bag, or the like, where the beverages can be easily transported for consumption by the user without considerable effort.

Thus, one advantage of the present invention is that the cooling apparatus will actually cool a warm beverage for later consumption.

Another advantage of the present invention is that the cooling apparatus is fairly compact and will either fit within, or readily attach to, a conventional golf bag.

Yet another advantage of the present invention is that the cooling apparatus can be broken down into individual lengths that are compact enough to fit within a conventional freezer.

A still further advantage of the present invention is that beverages can be maintained at cooler temperatures for extended periods of time since the beverages are surrounded by a material that is initially cooled.

Additional objects, advantages, and features of the present invention will become apparent from the following description and appended claims, taken in conjunction with the accompanying drawings.

BRIEF DESCRIPTION OF THE DRAWING

FIG. 1 is a perspective view of one embodiment of the cooling apparatus of the present invention illustrating the cooling apparatus in an operative configuration;

FIG. 2 is an exploded perspective view illustrating the cooling apparatus of FIG. 1 disassembled in accordance with the principles of the present invention;

FIG. 3 is a perspective view of the cooling apparatus illustrated in FIG. 1 showing the beverage containers being removed from the cooling apparatus by manually forcing a beverage container at the lower end of the cooling apparatus axially inwardly, thereby forcing the beverage containers therein axially such that a beverage container at the opposite end of the tubular members can be removed;

DETAILED DESCRIPTION OF THE PREFERRED EMBODIMENT

Figure 4:
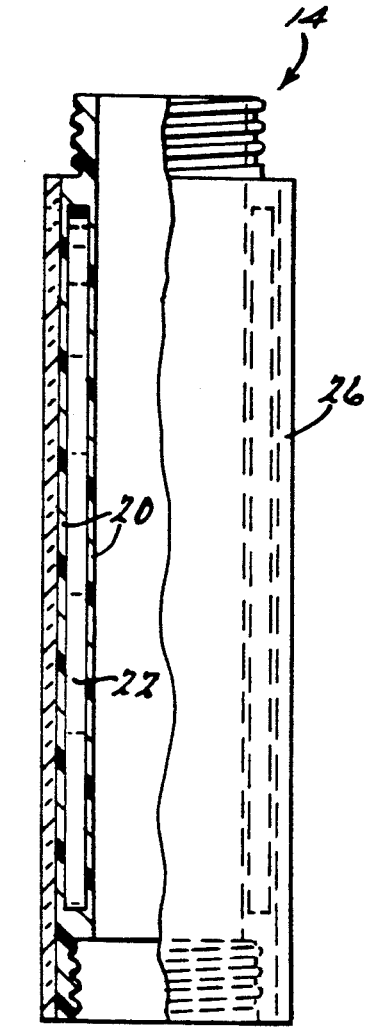
FIG. 4 is a front view of a portion of the cooling apparatus shown in FIG. 1 with a portion broken away thereby revealing, in ross section, a hollow tubular member having freezable material therein and an insulative layer, both of which surround the beverage containers.
Figure 6:
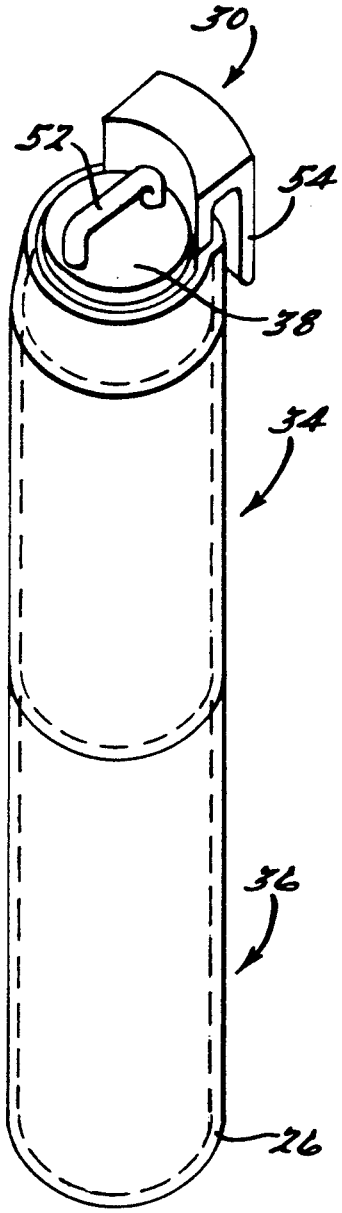
FIG. 6 is a perspective view of an alternate embodiment of the cooling apparatus of the present invention illustrating the cooling apparatus in an operative configuration.
Figure 5:
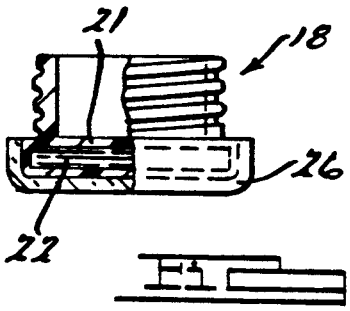
FIG. 5 is a front view of a portion of the cooling apparatus shown in FIG. 1 with a portion broken away thereby revealing, in cross section, an end portion having a freezable material therein and an outer insulative layer.

Referring now to the drawings, and in particular FIG. 1, the cooling apparatus of the present invention is shown. The embodiment depicted in FIGS. 1-5 is a cooling apparatus 10 having an upper tubular member 12 and a lower tubular member 14 threadingly coupled to one another along with upper and lower end portions 16 and 18 that cap the tubular members 12 and 14. These particular end caps 16 and 18 are threaded to sealingly engage the ends of the tubular members 12 and 14, however, in other embodiments they may be merely inserted into the ends of the tubular members 12 and 14 or otherwise affixed thereto. In any case, the walls 20 of the tubular members 12 and 14 and the walls 21 of the end caps 16 and 18 are made of a plastic material and define cavities therein, as shown in FIGS. 4 and 5. These cavities are preferably filled with a freezable material 22 such as water or a conventional refrigerant gel such as that disclosed in U.S. Pat. No. 4,357,809. One of ordinary skill in the art would certainly recognize that any number of cooling materials could be utilized for such a purpose. The tubular members 12 and 14 are preferably of a length for containing about three conventional beverage cans. Tubular members of this length can be easily placed in a conventional freezer to cool the freezable material 22 prior to use. The cooled freezable material within the tubes 12 and 14 provide a cooling means for any beverage containers 24 disposed within the tubes 12 and 14. Note that the tubular members 12 and 14, and the end caps 16 and 18, may also be encased with an insulative material 26, such as a closed cell neoprene material, a self skinning urethane or the like, such that the cooling effect created by the freezable material 22 is insulated from a warmer exterior environment.

One advantageous feature of the embodiment illustrated in FIGS. 1 through 5 lies in the fact that there are relatively few, easily manufactured parts that are readily assembled and disassembled for use. For example, to use this configuration, the end caps 16 and 18 are removed from the tubular members 12 and 14 and the tubular members 12 and 14 are detached from one another. The short lengths of tubular members 12 and 14 and the end caps 16 and 18 are placed in the freezer until the freezable material 22 is cooled and therefore ready for use. The tubular members 12 and 14 are removed rom the freezer and attached to one another thereby forming an elongated tube 28. Beverage containers 24 can then be inserted directly into this elongated tube 28, one after another end to end, until the entire length of the elongated tube 28 is filled with beverage containers 24. Once the elongated tube 28 is filled, the end caps 16 and 18 are attached to the ends of the tubes 12 and 14 until it is desirable to remove one of the containers 24 for consumption of the beverage therein. Note that one or more tubular members 12 and 14 may be utilized depending on the number of beverage containers 24 to be transported and eventually consumed.

When a beverage container 24 is to be removed from the cooling apparatus 10, one end cap 16 or 18 can be removed and the elongated tube 28 can be tipped such that a beverage container 24 simply slides out of the elongated tube 28. On the other hand, if the beverage containers 24 fit snugly within the elongated tube 28, both end caps 16 and 18 can be removed and a beverage container 24 at one end of the elongated tube 28 can be pushed inwardly such that the beverage container 24 at the opposite end is forced out, as shown in FIG. 3. In either case, after a beverage has been consumed, the empty container is simply inserted into the other end of the elongated tube 28, thereby preventing any litter and/or clutter due to the empty containers.

Figure 7:
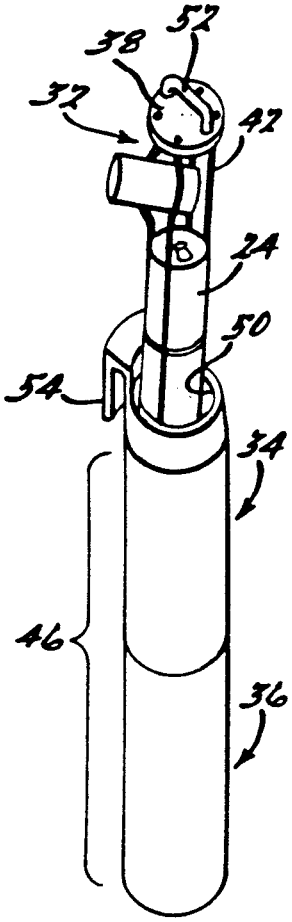
FIG. 7 is a perspective view of the cooling apparatus in FIG. 6 illustrating the beverage containers being removed from the cooling apparatus by withdrawing a receiving device from the tubular members in accordance with the principles of the present invention.
Figure 8:
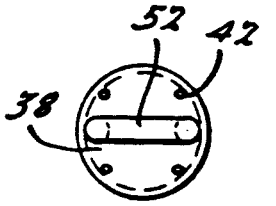
FIG. 8 is a top view of the receiving device of the embodiment shown in FIG. 6.
Figure 9:
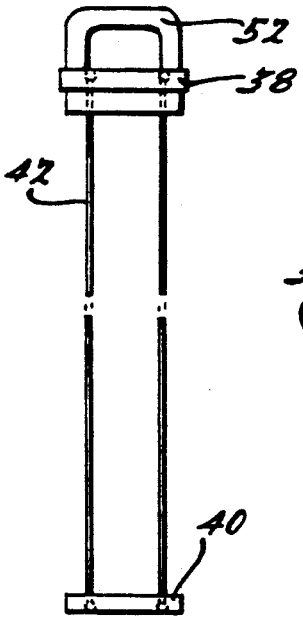
FIG. 9 is a front view of the receiving device of the present invention illustrating two end members coupled to one another by a plurality of cables for receiving beverage containers such that they can be inserted into and removed from the tubular members.

FIGS. 6 through 12 illustrate the preferred embodiment of a cooling apparatus 30 of the present invention that utilizes a receiving member 32 for holding the beverage containers 24 as they are inserted into and withdrawn from the tubular members 34 and 36. As best illustrated in FIGS. 8 and 9, one embodiment of this receiving member 32 comprises two end members 38 and 40 coupled to one another by a plurality of cables 42, preferably four. Beverage containers 24 are placed between the cables 42 where they are retained for insertion into and removal from the tubular members 34 and 36. Note that while the receiving member 32 illustrated in FIGS. 7, 8 and 9 is preferred, one of ordinary skill in the art would certainly recognize that any number of alternate designs could be utilized.

As with the previously described embodiment, the tubular members 34 and 36 are placed in the freezer until the freezable material 44 is cooled and therefore ready for use. The tubular members 34 and 36 are removed from the freezer and attached to one another thereby forming an elongated tube 46, as illustrated by FIGS. 5 through 9. Note that with this configuration, the lowermost tube 36 has an integral end portion 48 and does not require an end cap. The desired number of beverage containers 24 are placed within the receiving member 32 and inserted into the elongated tube 46. The upper end member 38 on the receiving member 32 has a reduced diameter portion 49 that snugly inserts into the mouth 50 of the upper portion of the elongated tube 34, thereby sealingly enclosing the beverage containers 24 within the elongated tube 46. To remove a beverage container 24, the user merely grasps the handle 52 on the upper end member 38 and withdraws the receiving member 32 from the elongated tube 46. A beverage container 24 can then be easily removed from between the cables 42 and the receiving member 32 reinserted into the elongated tube 46. Once again, when the beverage has been consumed the empty containers can be placed back into the receiving member 32 thereby preventing litter and/or clutter.

A further advantageous feature of the cooling apparatus of the present invention is that it can be readily manufactured via injection molding of thermoplastics or the like. Each part is molded utilizing conventional injection molding techniques. After the tubular members 12,14,34 and 36 are molded, a cooling material such as refrigerant gel is placed within the hollow tubular members 12,14,32 and 36 and an insulative material 26 can be placed about the tubular members. The various components can then be assembled in accordance with the principles of the present invention. With regard to the receiving member 32, the cables 42 are attached to the injection molded end members 38 and 40 as shown in FIGS. 8 and 9. Note that the cables 42 are relatively stiff such that while the cables 42 are flaccid enough to insert beverage containers 24 between the cables 24, and to collapse and insert the cables 42 into an elongated tube 46 having an axial length less than the extended length of the cables 42, the cables 24 are stiff enough to maintain a spaced relationship between end members 38 and 40. Thus, not only is the present invention superior in its compactness and its ability to cool and maintain beverages at a cool temperature, it is also adapted for relatively inexpensive and uncomplicated manufacture.

Figure 10:
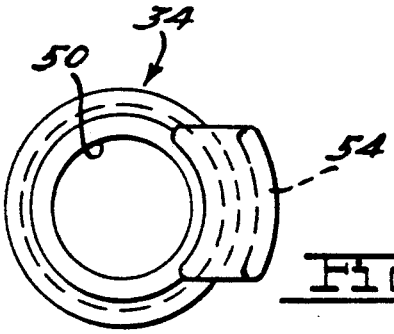
FIG. 10 is a top view of the cooling apparatus shown in FIG. 6.
Figure 11:
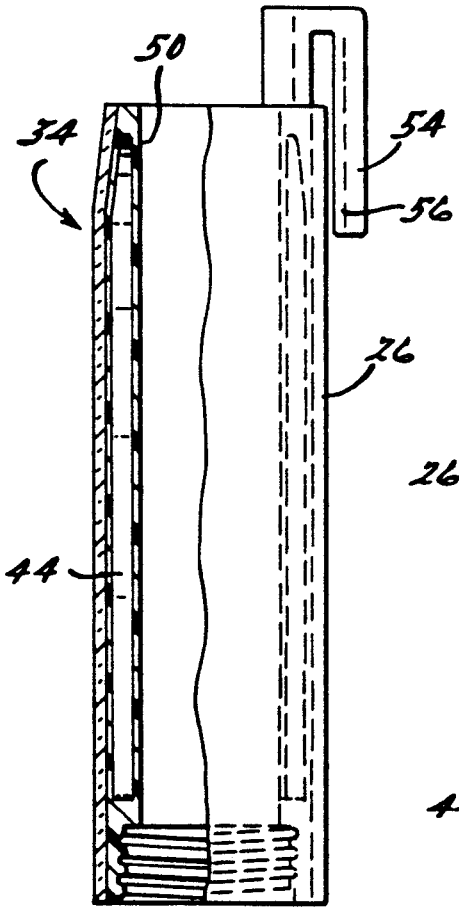
FIG. 11 is a front view of a portion of the cooling apparatus shown in FIG. 6 with a portion broken away thereby revealing, in cross section, a hollow tubular member having freezable material therein and an insulative layer, both of which surround the beverage containers.
Figure 12:
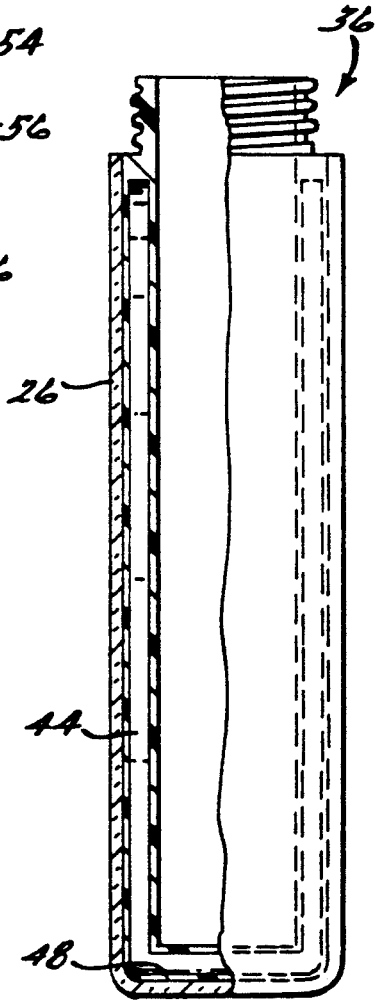
FIG. 12 is a front view similar to FIG. 11 illustrating the cross section of yet another hollow tubular member having freezable material therein and a layer of insulative material in accordance with the principles of the present invention.
Figure 13:
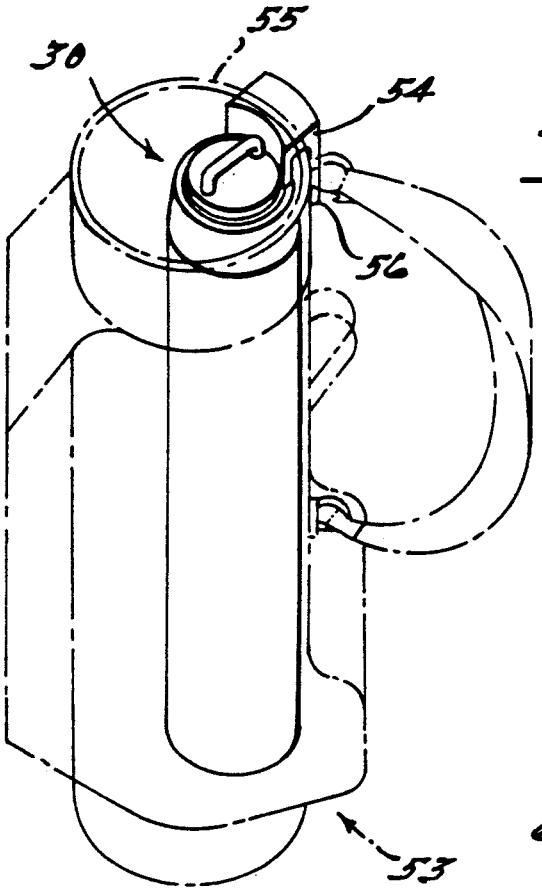
FIG. 13 is a perspective view of the cooling apparatus of the present invention shown within a golf bag that is illustrated in phantom.
Figure 14:
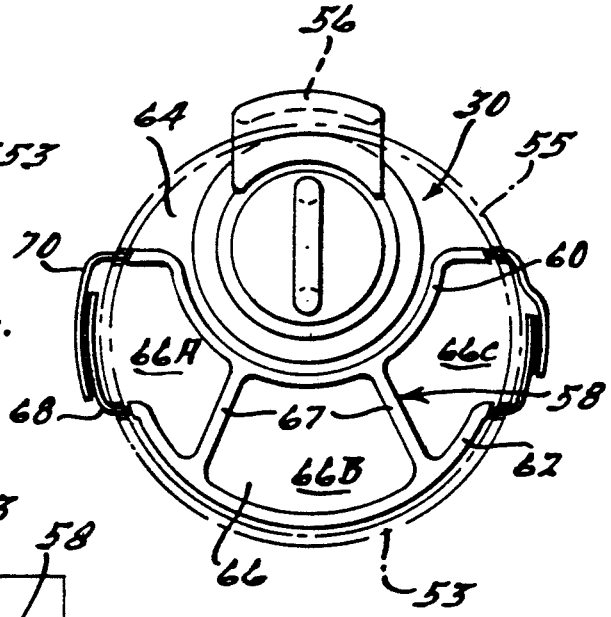
FIG. 14 is a top view of the cooling apparatus of the present invention shown within a golf bag having a specialized club organizer.
Figure 15:
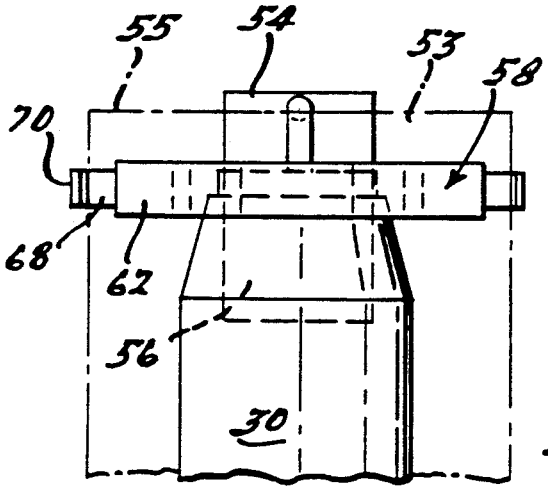
FIG. 15 is a front view of the cooling apparatus of the present invention within a golf bag utilizing a specialized club organizer as illustrated in FIG. 14.

Both embodiments of the cooling apparatus 10 and 30 thus far disclosed are of a size that fits directly into a golf bag 53 or which can be easily secured to a golf bag or other objects as shown in FIGS. 13–15. Although the two embodiments 10 and 30 disclosed herein illustrate a preferred embodiment of an inverted U-shaped clip 54 that secures the cooling apparatus to an upper rim 55 of a golf bag 53, many other embodiments may be utilized. As best shown in FIGS. 10 and 11, this particular clip 54 extends upwardly from the top of the cooling apparatus 30 such that the inverted U-shaped clip 54 acts as a hook for clipping downwardly onto the upper rim 55 of a golf bag. The downwardly extending portion of the clip is an arcuate wall 56 extending parallel to the tubular member 34. As shown in FIGS. 13 and 14, this arcuate wall 56 engages the outside of a golf bag 53 and acts to hold the cooler 30 against the inner wall of the golf bag 53 in a secure nature, while allowing it to be readily lifted and removed from the golf bag 53.

In order to insert the cooling apparatus 30 into a golf bag 53, some golf bags may require the use of a specialized and unique club organizer 58 that inserts into, and attaches to, the golf bag 53. This club organizer 58 is preferably made of a plastic material and divides the opening in the upper end of the golf bag 53 into smaller openings. As shown in FIG. 14, one of these smaller openings 64 is utilized for receiving the cooling apparatus 30 of the present invention, while golf clubs can be inserted into the remaining openings. The club organizer 58 preferably utilizes two curved members 60 and 62. The first curved member 60 extends across the opening in the upper portion of the bag, from one side of the bag 53 to the other, thereby dividing the bag into the smaller openings 64 and 66. As best illustrated in FIG. 14, this first member 60 is curved such that the cooling apparatus of the present invention can readily and efficiently fit within the opening 64. The second curved member 62 extends along the inner wall of the golf bag 53 adjacent thereto. In addition, cross members 67 extend between the curved members 60 and 62 to subdivide the opening 66 into subopenings 66A,66B and 66C for various types of clubs.

The club organizer 58 is easily secured to the golf bag 53 by simply removing any existing club organizer and replacing it with the organizer 58 of the present invention. The organizer 58 is preferably secured to the golf bag 53 by feeding strips of velcro 68 and 70, extending from the ends of the curved members 60 and 62, through conventional retaining slots in the rim 55 of the golf bag and securing the velcro strips to one another. Although velcro is preferred, one of ordinary skill in the art would certainly recognize that other retaining devices such as buckles, straps or the like would also accomplish the same function. Accordingly, the club organizer 58 of the present invention adapts a conventional golf bag 55 to allow for the insertion of a cooling apparatus, while simultaneously functioning to separate golf clubs within the golf bag 53.

In short, the cooling apparatus of the present invention can be easily broken down and placed in a conventional freezer and, when fully assembled, is still small enough to be inserted into a golf bag. The cooling material within the walls of the tubular members provide an actual cooling effect on the beverage containers disposed therein and therefore prolong the effectiveness of the device's ability to keep a beverage cool. Furthermore, beverage containers, including empty beverage containers, are easily inserted into and withdrawn from the elongated tubular members. Thus, not only is this cooling apparatus quick and easy to use, it also prevents clutter and/or litter resulting from the empty containers.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

I claim:

1. A beverage cooling apparatus comprising:

(a) a plurality of tubular members for surrounding a plurality of beverage containers placed therein and at least a portion of each of said tubular members including a cooling material;

(b) means for coupling said tubular members to one another thereby forming an elongated tubular configuration; and (c) receiving means having an extended length greater than an axial length of one of said tubular members, said receiving means comprising a plurality of elongated flaccid members for receiving said beverage containers, said receiving means adapted for manual insertion into, and manual withdrawal from, one or more of said tubular members such that when said flaccid members are inserted into said tubular members, beverage containers received by said flaccid members are placed in close proximity to said cooling material, and when said flaccid members are withdrawn from said tubular members, said beverage containers are withdrawn therewith.

2. The beverage cooling apparatus of claim 1 wherein said cooling material is a refrigerant gel.

3. The beverage cooling apparatus of claim 1 wherein said cooling material is water.

4. The beverage cooling apparatus of claim 1 wherein said beverage cooling apparatus has an attaching means for attaching said cooling apparatus to an object.

5. The beverage cooling apparatus of claim 1 wherein said tubular members have a layer of insulative material adjacent said cooling material at a location radially outwardly of said freezable material.

6. The beverage cooling apparatus of claim 1 wherein said beverage cooling apparatus further comprises end means for capping the ends of said tubular members.

7. The beverage cooling apparatus of claim 1 wherein said plurality of elongated flaccid members comprises a plurality of cables which are coupled to one another by two end caps such that said beverage containers can be placed between said cables, thereby being captured by said cables, for insertion into and removal from said tubular members.

8. The beverage cooling apparatus of claim 1 wherein said means for coupling said second tubular members to one another are mating threaded portions which thread together.

9. A compact beverage cooling apparatus comprising:

(a) a first annular member, said member having a wall defining a cavity therein for containing a freezable material;

(b) a second annular member, said member having a wall defining a cavity therein for containing a freezable material;

(c) means for coupling said first member to said second member, thereby forming an elongated annular member; and (d) receiving means having an extended length greater than an axial length of one of said tubular members, said receiving means comprising a plurality of collapsible members for receiving a plurality of beverage containers and for temporarily capturing said beverage containers as said receiving means is inserted into and withdrawn from said elongated annular member, such that said plurality of beverage containers can be placed within said elongated annular member, thereby cooling said beverage containers until said receiving means is withdrawn from said elongated annular member and said beverage containers are removed from said receiving means.

10. The beverage cooling apparatus of claim 9 wherein said apparatus further comprises insulating means surrounding said first annular member and said second annular member for insulating said freezable material.

11. The beverage cooling apparatus of claim 9 wherein said freezable material is a refrigerant gel.

12. The beverage cooling apparatus of claim 9 wherein said freezable material is water.

13. The beverage cooling apparatus of claim 9 wherein said beverage cooling apparatus has an attaching means for attaching said cooling apparatus to an object.

14. The beverage cooling apparatus of claim 9 wherein said first and second annular members have a layer of insulative material adjacent said freezable material at a location radially outwardly of said freezable material.

15. The beverage cooling apparatus of claim 9 wherein said beverage cooling apparatus utilizes end means for capping the ends of said annular members.

16. The beverage cooling apparatus of claim 9 wherein said plurality of collapsible members comprises a plurality of cables which are coupled to one another by an end cap such that said beverage containers can be placed between said cables, thereby being retained by said cables, for insertion into and removal from said elongated annular member.

17. The beverage cooling apparatus of claim 9 wherein said means for coupling said first annular member to said second annular member are mating threaded portions which thread together to form said elongated annular member.

* * * * *